US005715940A

United States Patent [19]

Son

[11] Patent Number: 5,715,940

[45] Date of Patent: Feb. 10, 1998

[54] PAPER BUFFERING MATERIAL FOR PRE-PACKING ELECTRONICS PRODUCTS

[75] Inventor: Young Ho Son, Kyoungsangbuk-Do, Rep. of Korea

[73] Assignee: LG Electronics, Inc., Seoul, Rep. of Korea

[21] Appl. No.: 674,449

[22] Filed: Jul. 2, 1996

[30] Foreign Application Priority Data

Jul. 31, 1995 [KR] Rep. of Korea ..... U95-19661

[51] Int. Cl.[6] ..... B65D 85/00

[52] U.S. Cl. ..... 206/320; 206/587; 206/592; 206/814

[58] Field of Search ..... 206/320, 521, 206/586, 587, 588, 591, 592, 593, 594, 814; 428/137, 138, 156, 161, 162, 165, 119, 120

[56] References Cited

U.S. PATENT DOCUMENTS

| | | | |
|---|---|---|---|
| 2,319,966 | 5/1943 | Wood et al. | 206/588 |
| 2,863,595 | 12/1958 | Emery | 206/587 |
| 3,144,973 | 8/1964 | Heintzelman | 206/591 |
| 3,619,216 | 11/1971 | Weinstein . | |
| 3,938,661 | 2/1976 | Carmody | 206/594 |
| 4,019,672 | 4/1977 | Giannini . | |
| 4,122,946 | 10/1978 | Holley | 26/588 |
| 4,278,170 | 7/1981 | Nauheimer . | |
| 5,127,526 | 7/1992 | Vigue | 206/587 |
| 5,207,327 | 5/1993 | Brondos | 206/592 |
| 5,515,976 | 5/1996 | Moren et al. | 206/592 |

FOREIGN PATENT DOCUMENTS

| | | | |
|---|---|---|---|
| 405051070 | 3/1993 | Japan | 206/588 |
| 688314 | 3/1953 | United Kingdom . | |
| 704045 | 2/1954 | United Kingdom . | |
| 957796 | 5/1964 | United Kingdom . | |
| 1 466 310 | 3/1977 | United Kingdom . | |
| 2107284 | 4/1983 | United Kingdom | 206/588 |
| WO 92/21571 | 12/1992 | WIPO . | |

*Primary Examiner*—Paul T. Sewell
*Assistant Examiner*—Nhan T. Lam
*Attorney, Agent, or Firm*—Fish & Richardson P.C.

[57] ABSTRACT

A paper buffering material for pre-packing an electronic product which can replace the conventional foamed polystyrene resin. The buffering material includes a paper panel of predetermined width and shape, which has a plurality of grooves in predetermined portions thereof to fix and support the electronic product and a plurality of ribs on both surfaces of the panel to buffer external impacts.

6 Claims, 2 Drawing Sheets

PAPER BUFFERING MATERIAL FOR PRE-PACKING ELECTRONICS PRODUCTS

BACKGROUND OF THE INVENTION

1. Field of the Invention

The present invention relates to a buffering material for pre-packing electronic products, more particularly to a buffering material recycled from papers for buffering electronic products to be packed in a box from external impacts.

2. Description of the Prior Art

Foamed polystyrene resin, which is known to have excellent buffering effects, has been conventionally used as a buffering material for pre-packing electronic products to be packed in a box subject to external impacts. Generally, foamed polystyrene resin is first laid within a packing box before an electronic product is placed therein. In the alternative, foamed polystyrene resin is inserted into the space between the electronic product and the packing box. The size and shape of the foamed polystyrene resin depend on the design of the electronic product and the packing method. The foamed polystyrene resin covers either the entire surface or upper and lower parts of the electronic product.

However, foamed polystyrene resin poses several problems notwithstanding its excellent buffering effects. Firstly, it cannot be recycled once used. Secondly, the electronic products manufacturers bear an extra burden of recollecting the waste foamed polystyrene resin to comply with the consumers' request. Thirdly, additional expenses are incurred to dispose of the recollected foamed polystyrene resin.

SUMMARY OF THE INVENTION

It is an object of the present invention to resolve these conventional problems, and to provide a paper buffering material for pre-packing electronic products which is made of recycled paper panels and thus substitutes for the buffering material of foamed polystyrene resin, thereby contributing to environmental protection and recycling of natural resources, which are issues of increasing importance.

To achieve the above object, the present invention provides a paper buffering material for pre-packing an electronic product having predetermined thickness and width, and covering at least one surface of said product to be packed in a packing box, the paper buffering material comprising:

at least one paper panel including at least one groove, formed on a predetermined portion of said paper panel and receiving predetermined parts of said product therein, for fixing and supporting said product, and buffering means formed on both surfaces of said panel for buffering said product from external impacts.

The buffering means preferably includes a plurality of first perpendicular ribs formed on one surface of the paper panel facing said product, and a plurality of second perpendicular ribs formed on the other surface of said paper panel.

BRIEF DESCRIPTION OF THE DRAWINGS

The above object, and other advantages of the present invention will become more clear by describing the preferred embodiments thereof with reference to the attached drawings, in which.

DETAILED DESCRIPTION OF THE PREFERRED EMBODIMENTS

FIGS. 1 to 4 show a buffering material recycled from paper according to the present invention. Referring to FIGS. 1 to 4, the buffering material comprises a paper panel 1 of predetermined thickness and width, a center groove 1A formed in the middle of the paper panel 1, first perpendicular ribs 2 and second perpendicular ribs 3 formed on both surfaces of the paper panel 1, respectively, for buffering external impacts.

The first perpendicular ribs 2 are formed on one surface of the paper panel 1 facing an electronic product 7. The second perpendicular ribs 3 are formed on the other surface of the paper panel 1. The first perpendicular ribs 2 and the second perpendicular ribs 3 are staggered, relative to each other, on the inner and outer sides of the paper panel 1.

Figure 1:
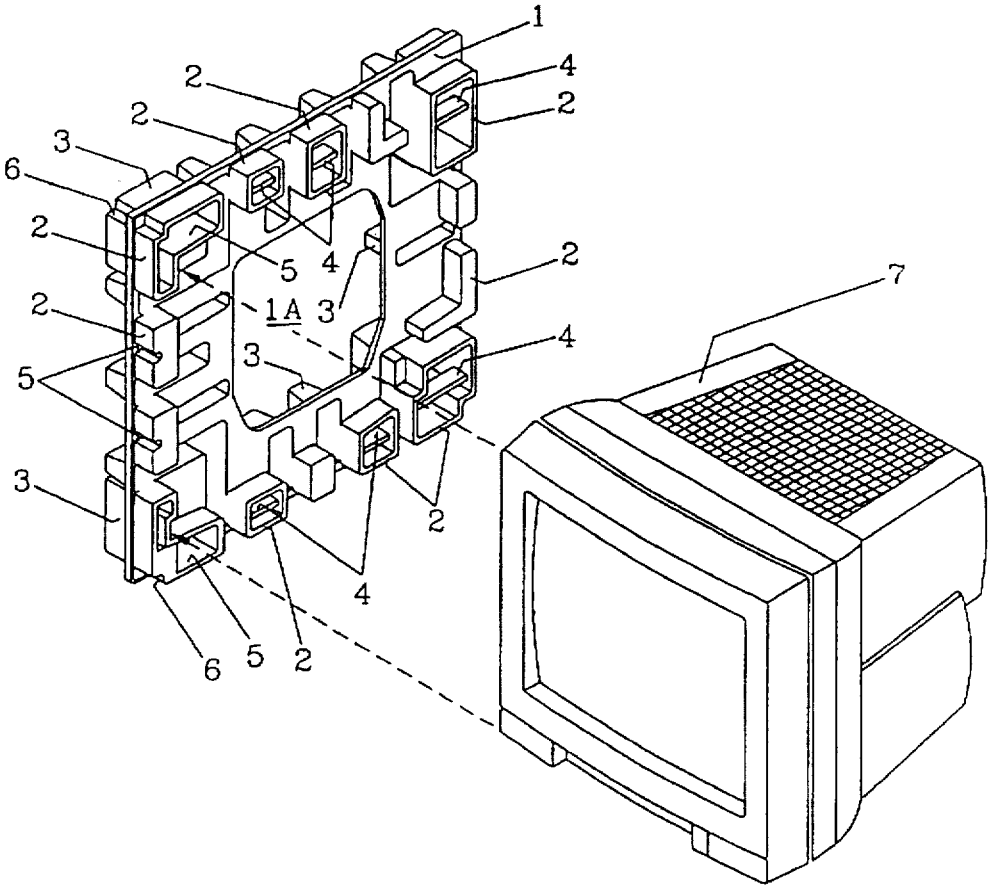
FIG. 1 is a left-side perspective view of the buffering material for pre-packing the electronic product according to the present invention.
Figure 3:
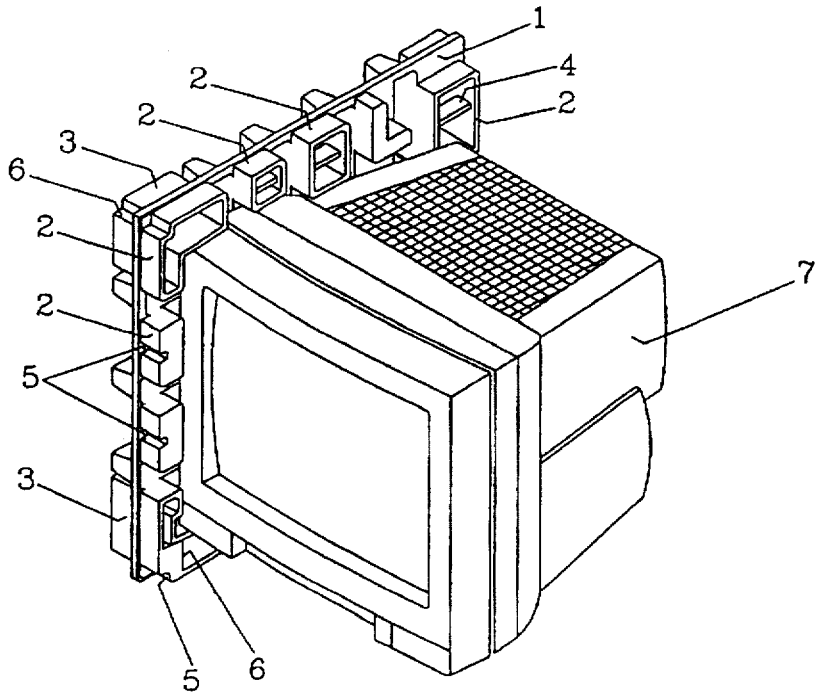
FIG. 3 is a left-side perspective view of the buffering material combined with the electronic product.

The first perpendicular ribs 2 is provided with open-end cubes to fit the design of the electronic product 7, within which buffering ribs 4 and buffering grooves 5 are formed to disperse the weight pressure of the electronic product 7. The height and number of the first perpendicular ribs 2 are defined by the design of the electronic product 7. As illustrated in FIGS. 1 and 3, "⊤"-shaped grooves 6 are formed at each corner of the perpendicular paper panel 1 to buffer the impacts from each corner of the angles. Each edge of groove 6 may be chamfered in the form of a tapered or rounded surface to buffer the impacts from each corner.

Second perpendicular ribs 3 have an even height to face the packing box. Additional buffering ribs and buffering grooves may be formed to increase buffering effects.

Figure 2:
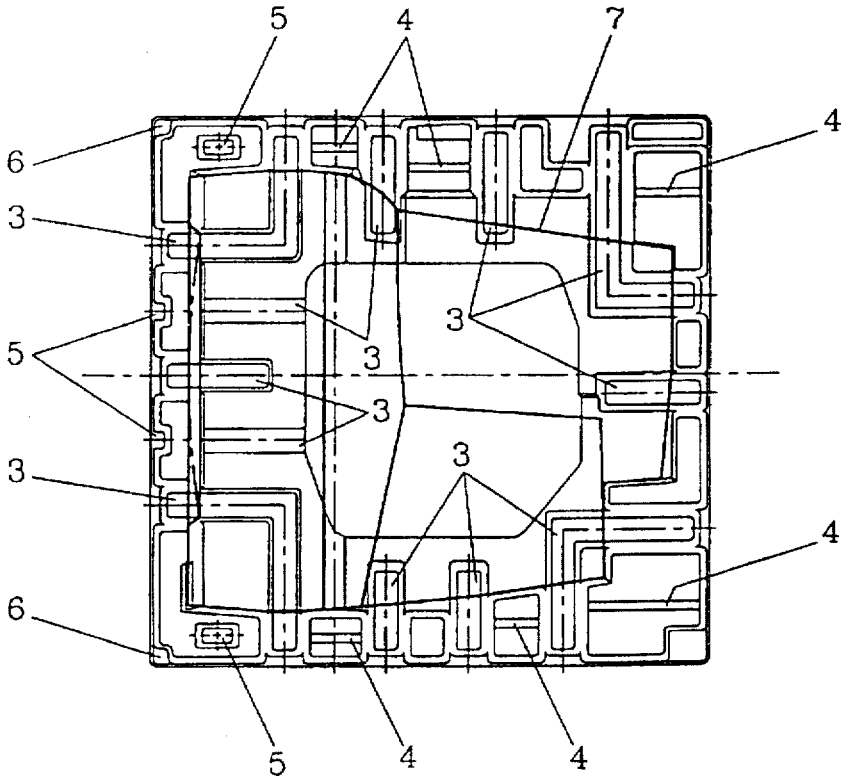
FIG. 2 is a left-side top plan view of the buffering material for pre-packing the electronic product according to the present invention.
Figure 4:
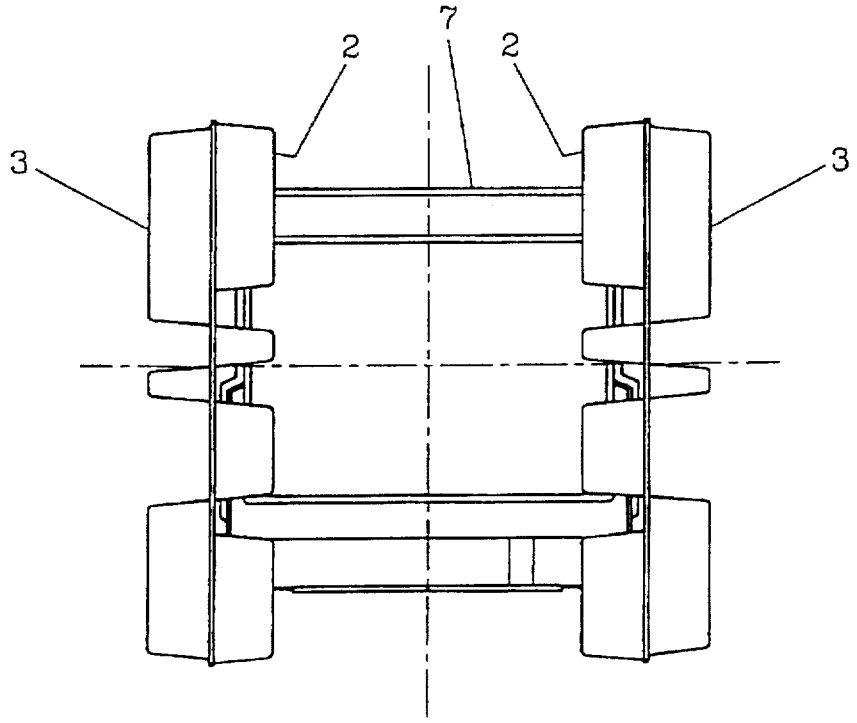
FIG. 4 is a front view of the buffering material combined with an electronic product.

In the embodiment of FIGS. 2 and 4, the paper buffering panel having the above structure may be combined with the left and right surfaces of the electronic product. The paper panel may also be combined with any two opposite surfaces of the electronic product depending on the design and vulnerability of the electronic product. The two opposite surfaces of the electronic product may be the left and right surfaces, the front and back surfaces, or the upper and lower surfaces thereof.

Specifically, a pair of left and right paper panels are required in case of combining them with the left and right surfaces of the electronic product. FIGS. 3 and 4 show how an electronic product is pre-packed with buffering panels. The left and right surfaces of the electronic product 7 are winged with a pair of buffering panels comprising a plurality of first perpendicular rib 2. The electronic product 7 is then placed in a packing box.

Packing the electronic product 7 as described above has an effect of absorbing impacts from the upper and lower directions of the product into the perpendicular ribs 2 and 3 which have been formed on the front and rear sides of the paper panel 1 in predetermined heights and shapes. The buffering ribs 4 formed across the middle outlet of the paper panel 1 double the buffering impacts from the horizontal direction.

The buffering grooves 5 formed in the middle of the first perpendicular ribs 2 also double the buffering impacts from the horizontal direction. The buffering grooves 5 doubling the buffering effects also serve to disperse the pressure from the front part of the electronic product which weighs heavier than the other parts of the electronic product. Corner grooves 6 formed at the corners of the square paper panel 1 also absorb impacts from the corners, thereby protecting the electronic product 7 from external impacts in all directions.

As described above, the present invention provides a paper buffering material for pre-packing electronic products which can replace the conventional foamed polystyrene resin. Accordingly, the material can be recycled after use, thereby saving costs to be incurred for recollecting the discarded buffering material.

While the present invention has been described and illustrated herein with reference to the preferred embodiments thereof, it will be understood by those skilled in the art that various changes in form and details may be made therein without departing from the spirit and scope of the invention.

What is claimed is:

1. A paper buffering material for pre-packing an electronic product having predetermined thickness and width, and covering at least one surface of said product to be packed in a packing box, the paper buffering material comprising:

at least one paper panel including a plurality of first ribs on a first side of said panel and a plurality of second ribs on a second, opposite side of said panel, said first and second ribs arranged so that a position of at least one of the first ribs along the first side is staggered adjacent to a position of at least one of the second ribs along the second side, and at least one of said first ribs has a buffering groove formed therein, and at least one of said first ribs has a buffering rib formed therein, said buffering groove and rib constructed to dissipate pressure applied to the packing box, said first ribs having predetermined heights and shades and configured to be in contact along the first side of the panel with said electronic product and constructed to support the product, said paper panel having at least one of said first ribs and at least one of said second ribs positioned at each corner of said panel, said first and second corner ribs further comprising chamfers of a predetermined shape formed for buffering external impacts.

2. A paper buffering material as claimed in claim 1, wherein said plurality of said first and second ribs are provided with open-end cubes for fitting said electronic product.

3. A paper buffering material as claimed in claim 1, wherein heights and number of said first ribs are defined according to a design of said electronic product.

4. A paper buffering material as claimed in claim 1, wherein said paper panel further comprises grooves formed at each corner thereof for buffering external impacts.

5. A paper buffering material as claimed in claim 1, wherein said second ribs are formed with an even height.

6. A paper buffering material as claimed in claim 1, wherein at least one of said second ribs has a buffering groove formed therein, and at least one said second ribs has a buffering rib formed therein.

* * * * *